US006729371B2

(12) United States Patent
Sheahan et al.

(10) Patent No.: US 6,729,371 B2
(45) Date of Patent: May 4, 2004

(54) WORKBENCH

(76) Inventors: Kevin Sheahan, 4190 Danceglen Dr., Colorado Springs, CO (US) 80906; Thomas Bulk, 4655 Alpglen Ct., Colorado Springs, CO (US) 80906

( * ) Notice: Subject to any disclaimer, the term of this patent is extended or adjusted under 35 U.S.C. 154(b) by 0 days.

(21) Appl. No.: 09/775,753

(22) Filed: Feb. 5, 2001

(65) Prior Publication Data

US 2002/0104585 A1 Aug. 8, 2002

(51) Int. Cl.[7] ..... B25H 1/00

(52) U.S. Cl. ..... 144/286.1; 108/59; 144/286.5; 312/240; 312/257.1

(58) Field of Search ..... 108/61, 109, 8, 108/13, 62, 59; 144/286.1, 286.5; 312/240, 257.1

(56) References Cited

U.S. PATENT DOCUMENTS

| | | | | | |
|---|---|---|---|---|---|
| 431,745 | A | * | 7/1890 | Haven | 144/286.1 |
| 450,289 | A | * | 4/1891 | Gottfried | 144/286.1 |
| 681,098 | A | * | 8/1901 | Brown | 144/286.1 |
| 1,379,623 | A | * | 5/1921 | Hallowell | 144/286.1 |
| 4,265,283 | A | * | 5/1981 | Nash et al. | 144/286.1 |
| 5,115,847 | A | * | 5/1992 | Taber | 144/286.5 |
| 6,047,750 | A | * | 4/2000 | Jensen | 144/286.1 |

* cited by examiner

*Primary Examiner*—W. Donald Bray
(74) *Attorney, Agent, or Firm*—William E. Hein

(57) ABSTRACT

A household workbench assembly (1) that utilizes dry dimensional lumber, plywood, metal, and plastic to provide a versatile, rugged workbench, requiring minimal assembly time and having a pleasing cosmetic outer appearance. The versatility and simplicity of the workbench design comes from the unique primary metal leg design (2) that allows rapid attachment of all components (3–8). The leg (2) is constructed as a load bearing metal structural frame with a front to back length equal to the product of the average width of a specific type of dry dimensional lumber (7) times an integer number of pieces. Holes (12) located along the top surface of the metal leg and spaced appropriately provide for attachment of dry dimensional lumber and prevent the lumber from warping or splitting. Brace attachment holes (13) pre-drilled symmetrically about the vertical axis of the leg (2) and along the sides of each vertical member provide for attachment of all lateral and drawer support braces (3,4,5). There are two lateral support braces: one long lateral brace (3), which sets the width between a pair of legs (2) to a standard plywood width of 48 inches, and a short lateral brace (4), which sets the width for a standard plastic injection-molded drawer (6). With the use of a standard metal leg (2) and three types of braces (3,4,5) and commercially available dry dimensional lumber (7), also called "framing" lumber, workbench configurations of no drawers and no shelves, just plywood shelves (8), just drawers (6), or a combination of drawers and shelves can be readily configured with minimal time.

4 Claims, 9 Drawing Sheets

WORKBENCH

BACKGROUND OF THE INVENTION

1. Field of the Invention

The subject invention relates to a workbench, comprised of metal, wood and plastic injection-molded parts. More particularly, this invention relates to a standalone workbench comprised of a primary metal structure along with injection-molded plastic accessories that enable the user to create a contiguous set of workbenches of just drawers, just shelves, or a combination thereof, using commercially available dry dimensional lumber for the tabletop, four foot long plywood for the shelves, and plastic injection-molded drawers. More specifically, this invention relates to workbenches where the workbench leg design provides a tabletop front to back width equivalent to an integer number of dry dimensional lumber pieces laid with their widths placed side to side across the top. Proper hole positioning in the top of the workbench leg captures the dry dimensional lumber with simple wood screws and prevents the boards from warping and or splitting.

2. Description of the Prior Art

Workbenches are not new to the consumer market and, in general, range from the simplistic, consisting of four legs and a tabletop, either of plastic or wood, to complex industrial grade workbenches that are comprised primarily of metal and consist of legs, drawers, doors, shelves, and a tabletop. For industrial workbenches, the tabletop can be comprised of engineered wood, or depending on the application, take on a composite structure such as laminate over wood, chemically resistive materials, or electrostatic dissipating surfaces necessary for the manufacturing of electronics. More recently a series of portable workbenches of either injection-molded plastic or metal are available in the commercial market.

One instance of a plastic workbench is defined in U.S. Pat. No. 5,351,730, and is described as a carpenter's workbench. Created from injection-molded plastic it constitutes a free standing body, similar to an "A" frame design with a flattened molded top. Located within the molded top region are specialized molded compartments for retaining loose hardware, along with a molded grove to aid in severing lumber or pipe. The molded grove may constitute a region wherein a piece of 2 inch by 4 inch wood may be secured to the top to provide as a wood working surface if desired. The unique construction of this design makes it portable but the lightweight portable nature of this design does not render it a rugged, fixed work surface were power equipment imparting significant weight or vibration can be placed.

There are portable workbenches made of metal that also have the benefit of being able to fold, contain a vice, provide a built in measuring rule, or a combination thereof. Several such designs are defined in U.S. Pat. Nos. 4,252,304; 5,383,977; Des. 253,212; and Des. 386,624. The simplest of these designs is shown in U.S. Pat. No. Des. 253,212. A simple metal frame forms an A-frame metal leg construction with a flat like tabletop comprised of two block like surfaces that by means of two screw mechanisms running perpendicular to the work surface creates a vice for clamping. The most complex of these unique workbenches is provided in U.S. Pat. No. 5,383,977. A scissor like metal leg structure allows the structure to be folded together with the tabletop opening up to aid in collapsing the workbench. As incorporated in the previous, similar design, the tabletop contains a vice that is clamped with two screw mechanisms mounted perpendicular to the work surface. Additional useable features are incorporated in the design, such as a place to mount a power tool and places to retain several hand tools. Although the most complex of these designs contains numerous features, they are intended as portable work surfaces in the home or at a construction site. Moving such structures is simple, however the tabletop on such designs is not constructed to allow dry dimensional lumber, which is typically found at most home construction sites, to be rapidly installed and used as a rugged work surface.

For home construction and home use, a wood workbench or a shelving rack type structure with a rugged wood tabletop provides the most desired working surface. Tools can be rapidly attached and it provides a rigid but forgiving surface for most household projects. Wood workbenches do exist, such as that defined in U.S. Pat. No. 5,284,331. In that patent, a woodworking workbench is depicted with many integrated features for woodworking such as vises, dogs, panel clamps, hold-downs, and other means beneficial in woodworking. Such a design is rugged, sturdy, and can be configured to aid the workbench user in just about any hobby type of task. For woodworking it is ideal, but for the average home user it is far to complex and does not provide a simple scheme for attaching drawers.

There are workbenches available in the commercial market that are of a metal frame construction, have a wood tabletop, and contain drawers. These are workbenches that have a basic construction similar to metal shelving but which contain a particleboard top and may contain a drawer or drawers. A patent search for such products failed to identify these concepts, but to the best of our knowledge all such shelving type benches utilize plywood or particleboard tabletops. Such designs provide for rapid construction since the tabletop is primarily a shelf. However, relative to attaching power tools such as tablesaws, tabletop drill presses, etc., such designs are flawed since particleboard has poor tensile or flexural strength when compared with dry dimensional lumber. A workbench constructed with metal pieces such that the attached pieces are bolted or screwed together, and that has a tabletop comprised of commercially available dry dimensional lumber, provides the ideal structure for mounting of power tools, a vise, or other large items requiring strength.

As delineated in the patents cited there are a multitude of workbenches that exist. Plastic workbench surfaces provide portability, metal industrial workbenches provide ergonomic design centers for industry, all wood workbenches can be the hobbyists project, and metal shelving type workbenches provide a quick work surface. However, what is needed is a workbench structure that enables the homeowner to obtain dimensional lumber and rapidly construct a workbench with a solid tabletop, several plywood shelves, and drawers. To date, and to the best of our knowledge no such workbench concept exists or existed.

SUMMARY OF THE INVENTION

It is thus an object of the present invention to create a rugged workbench structure that allows for an economical tabletop to be rapidly constructed from an integral number of dry dimensional lumber pieces, such as 2×4's, 2×6's, 2×8's, 2×10's, and 2×12's, that are laid with their widths placed side by side, and attached via pre-drilled holes in said metal structure using simple wood screws, such as deck screws. Furthermore, the metal structure shall create proper spacing for sturdy plastic drawers, allow for shelves with a standard plywood width, contain pre-drilled holes for other accessories, and allow for a contiguous tabletop by providing for a complement of holes about the vertical axis of each leg.

According to further features in the preferred embodiments of the present invention, the workbench structure shall be comprised of a primary metal leg structure that has a front to back width equal to the product of the minimum dressed width for a specific type of dry dimensional lumber times an integer number of pieces, such that when their widths are laid side by side, it forms an economical and rugged tabletop.

According to further features in the preferred embodiments of the present invention, the primary leg structure top and bottom metal piece shall have holes positioned to secure the integer number of lumber pieces using simple wood screw retention, but which prevents splitting or warping of the dry dimensional by proper hole spacing.

According to further features in the preferred embodiment of the present invention, the primary leg structure shall have holes to provide up to three shelves, three drawers, securing to a wall and floor, and to allow each leg to attach to two other legs by means of lateral braces.

According to further features in the preferred embodiment of the present invention, there are two types of metal lateral support braces that space the legs apart: one lateral brace type shall provide exact spacing between the primary metal legs to achieve one or more plywood shelves with a length equal to 48 inches, or in other words the width of a standard plywood lumber sheet. The other lateral brace support shall provide proper spacing for a rugged plastic injection-molded drawer.

According to further features in the preferred embodiments of the invention, the workbench shall accept injection-molded plastic drawers consisting of an open box like structure, with or without structural webbing, having a front, rear, two sides, a bottom, and a structural lip for retention by means of two U-shaped metal braces positioned on the sides of two standard legs.

According to further features in the preferred embodiments of the invention, a metal U-shaped brace shall exist that when attached front to rear, and opposing each other on each of two vertical standing and parallel legs, it shall retain the drawer, and allow the drawer to slide opened and closed.

DESCRIPTION OF THE ACCOMPANYING DRAWINGS

DESCRIPTION OF THE PREFERRED EMBODIMENT

The principle of the present invention is to provide the primary metal structural components, and plastic accessories necessary for creating a series of rapidly assembled workbenches using commercially available dry dimensional lumber and plywood. Hence forth in this document the term "dry dimensional lumber", also referred to in the construction industry as framing lumber, shall have the dressed size dimensional width in accordance with American Softwood Lumber Standard, DOC PS 20-99, developed in accordance with the *Procedures for the Development of Voluntary Product Standards*, of the U.S. Department of Commerce. In addition, and in accordance with the definitions defined in DOC PS 20-99, abbreviations used herein, such as 2 by 4's, 2 by 6's, etc. refer to nominal size designations for lumber and do not reflect the actual size or what is termed "dressed size."

Specifically, it is the intent of the present invention to provide the end user with a primary metal leg structure that allows an integer number of dry dimensional lumber pieces, such as 2×4's, 2×6's, 2×8's, etc., to be laid with their widths placed side by side as the tabletop and attached via simple wood screws using holes properly positioned to prevent splitting or warping of said lumber. It is also the intent of the present invention to provide support bracing necessary to accommodate shelves with a length equivalent to the standard plywood width of 48 inches, and a standardized plastic injection-molded drawer. Through the use of a common leg structure with symmetrical holes positioned about its vertical axis, workbench configurations of just drawers, just shelves, or any combination thereof can be configured in a contiguous manner.

The use and operation of the present invention can best be understood by the reference drawings and the accompanying description.

Figure 1:
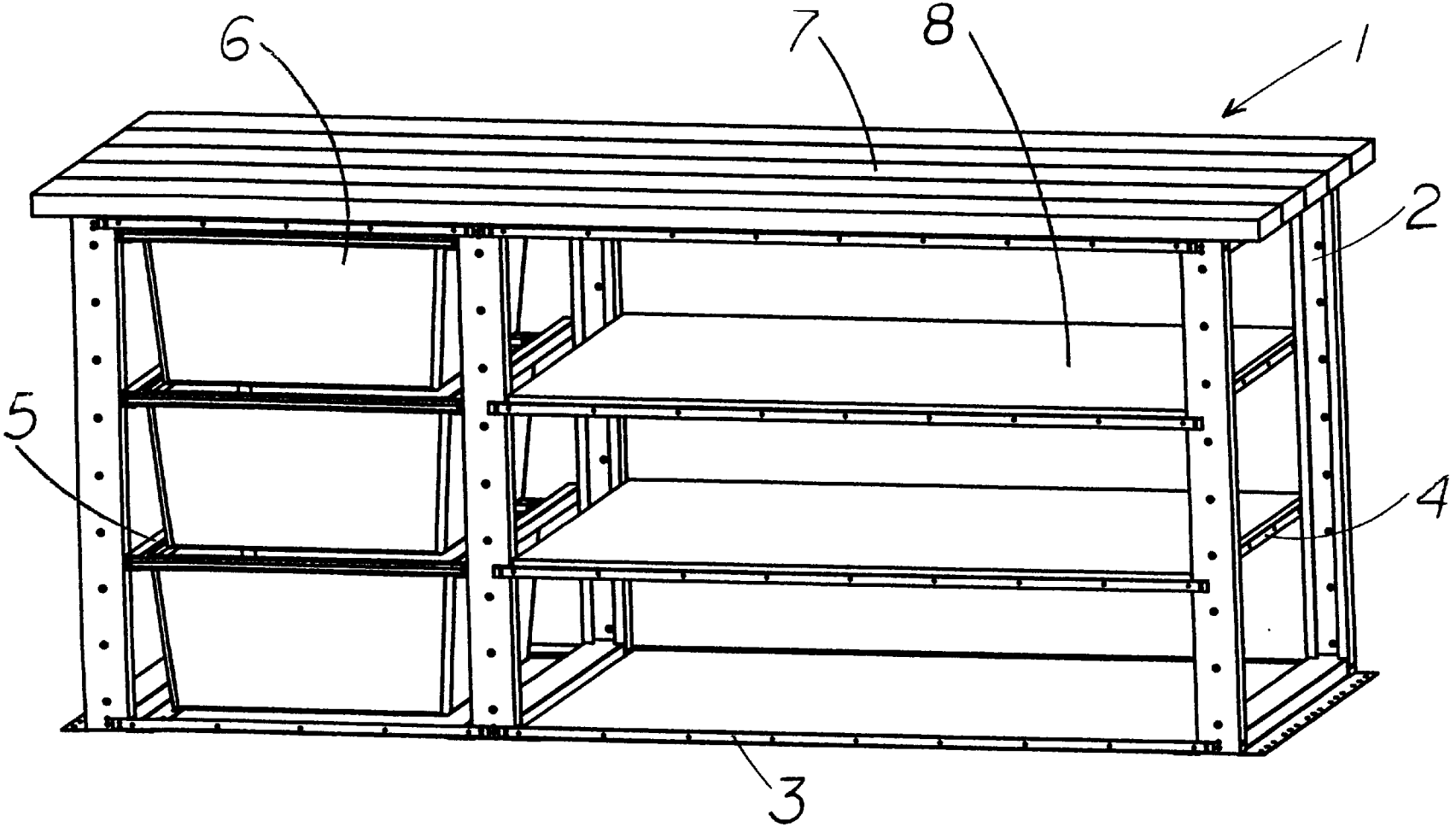
FIG. 1 is a top perspective view of a particular fully assembled workbench configuration of the present invention, consisting of three of the standard legs, a tabletop composed of five 2×6's, three 48 inch plywood shelves, and three plastic injection-molded drawers.
Figure 2:
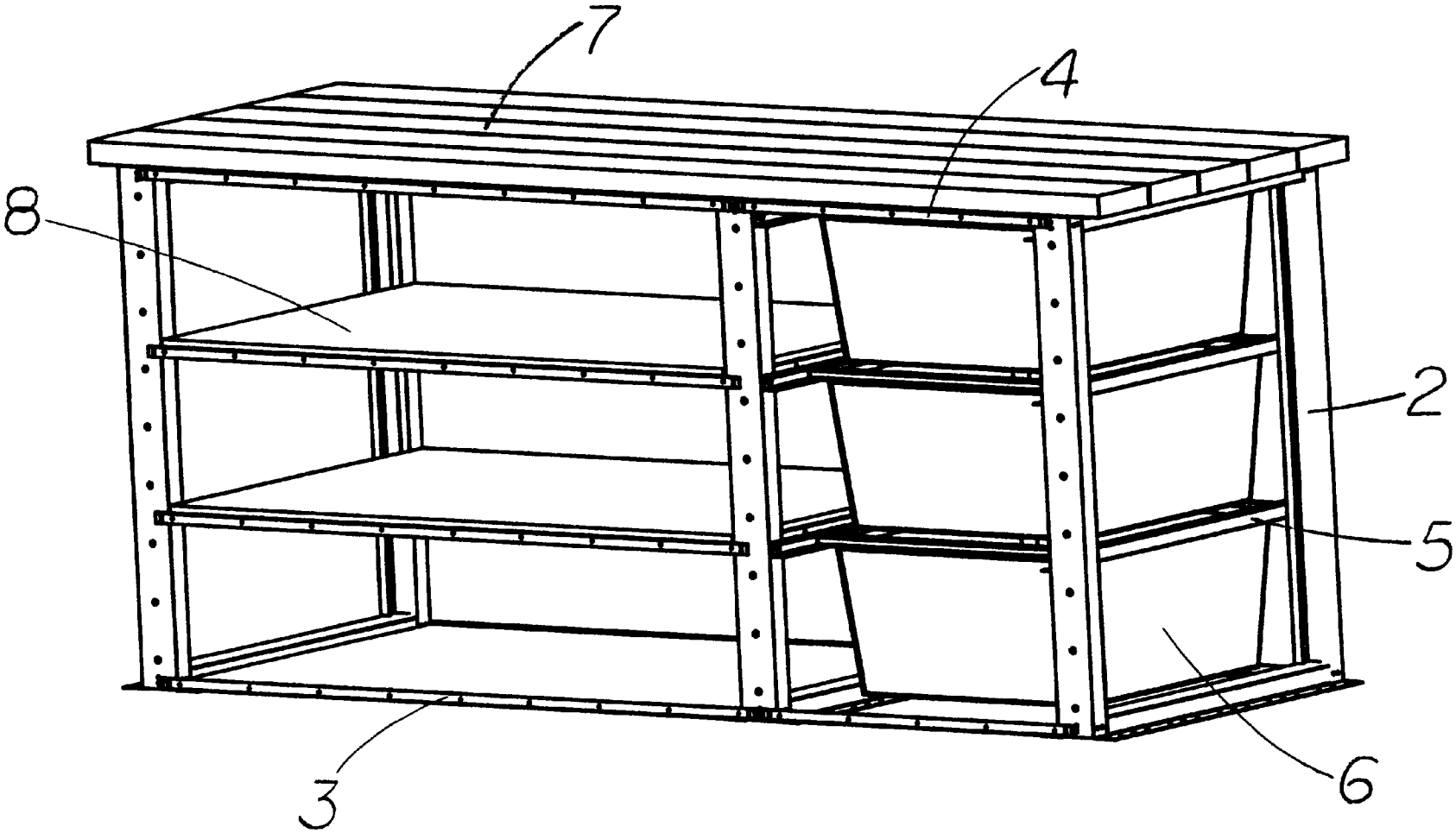
FIG. 2 is a rear perspective view of the particular configuration shown in FIG. 1.

FIGS. 1 and 2 provide a front and rear perspective view of one configuration of a fully assembled workbench 1 using the metal structural parts and plastic accessories defined by this present invention. Shown is a configuration comprised of three of the standard metal legs 2, eight long lateral metal braces 3, eight short lateral metal braces 4, six metal drawer support braces 5, three drawers 6, three plywood shelves 8, and six pieces of two inch by six inch dimensional lumber 7. The primary member of the workbench is the standard metal leg assembly 2, which has a front to back width equal to the face width of a particular type of dry dimensional lumber times an integer number of pieces. This particular leg configuration accommodates a tabletop comprised of five, two inch by six inch dry dimensional lumber pieces 7, as depicted. Spacing between the metal legs is set by utilizing either the long lateral brace 3, for setting shelf length, or by using the short lateral brace 4, for setting drawer width, both of which mount using metal screws to the front and rear of the primary metal leg 2. The long lateral brace 3 establishes a length sufficient to accommodate plywood or particleboard shelves with an industry standard equivalent width of 48 inches. The short lateral braces 4 ensure proper distance between the standard metal leg 2 to accommodate plastic drawers 6. Up to three plastic injection-molded drawers will fit in the area between two legs. To reduce the number of parts, the short lateral brace 4 also functions as front to back support for the plywood shelves 8. Supporting the drawers of the workbench and spanning front to back on the vertical members of the primary metal leg are U-shaped drawer support braces 5.

Figure 3:
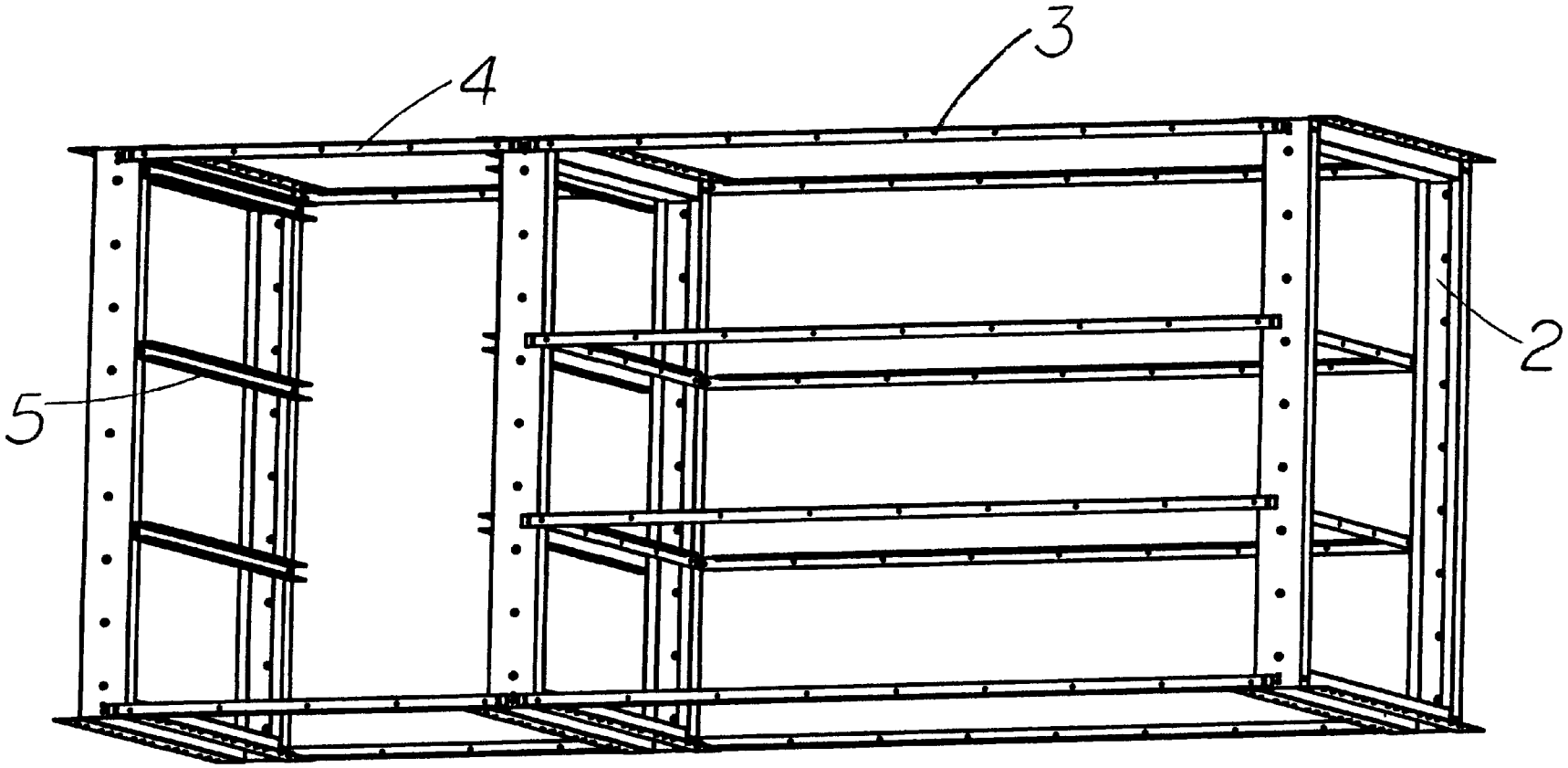
FIG. 3 is a perspective view of the workbench configuration provided in FIG. 1 with the plastic injection-molded drawers, plywood shelves, and 2×6's removed to show the metal structural components.

FIG. 3 provides a perspective view of the workbench primary metal structure with all plastic drawers 6, dry dimensional lumber 7, and plywood shelves 8 removed. To provide rigidity, prevent lateral motion, and to simplify assembly, a single type of metal screw is used to attach all metal support braces 3,4,5. Lateral brace attachment holes 13 pre-drilled in the vertical members of the standard leg 2 provide attach locations for metal support braces 3,4,5. Accessory holes 17 are provided in all lateral support braces to allow the user additional attach points for wood or plastic enclosures. In the event that the user prefers to use lag bolts to secure the dry dimensional lumber 7 to the top, or would like to secure the legs to a floor or wall, bolt holes 14 are provided on the top, bottom, front and rear sides of the leg 2.

Figure 4:
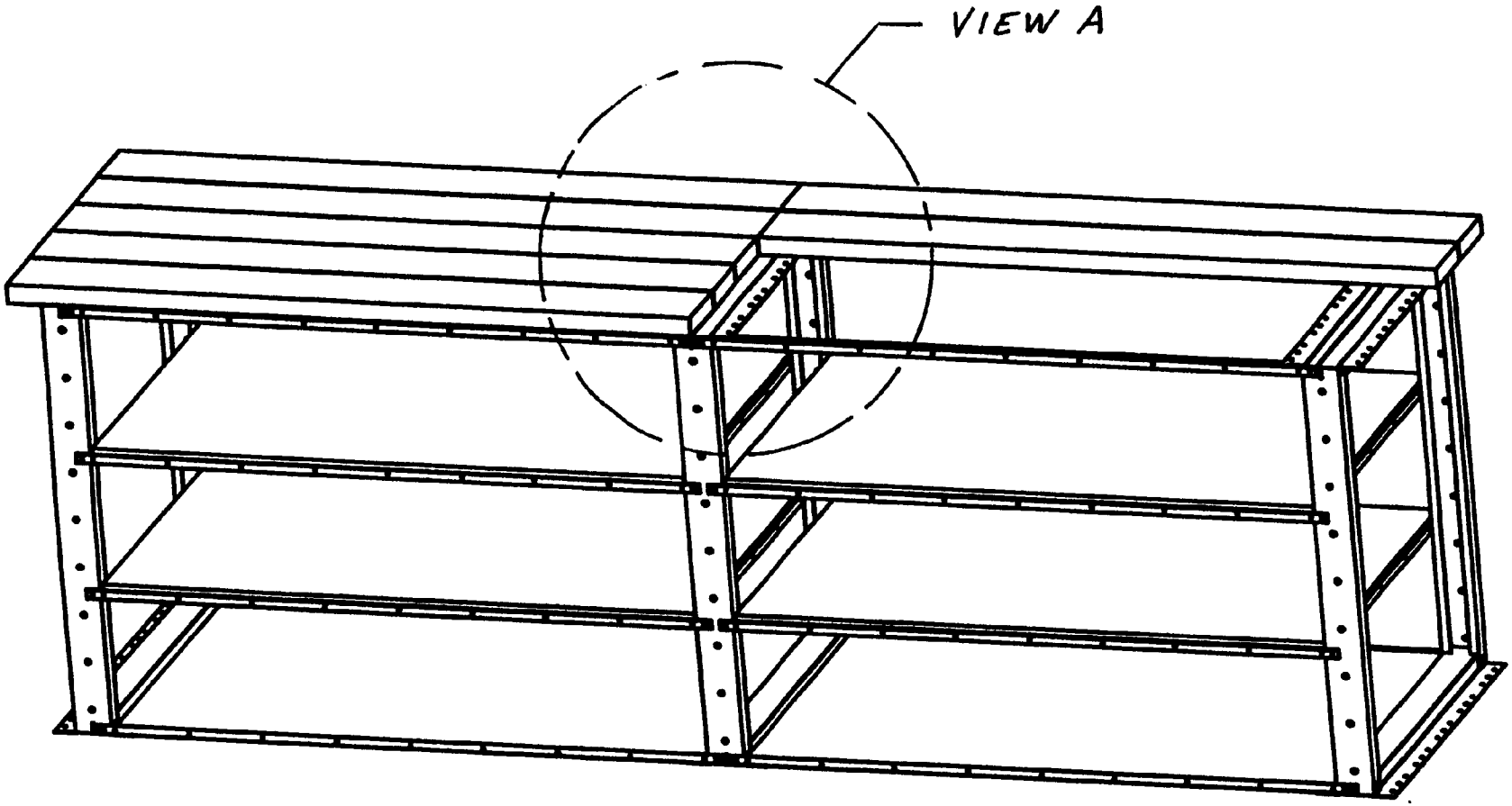
FIG. 4 is a perspective view of another workbench configuration using the same primary components identified in FIG. 1 but with the center leg shared between two workbench tabletops.

FIG. 4 shows a workbench configuration 9 of just shelves, created using some of the same structural components 2,3,4. The purpose of this configuration is to show that an individual leg assembly 2 can provide attachment of two sets of dry dimensional lumber 7 and can be used to create a multitude of configurations of only drawers, only shelves, or a combination thereof. In this particular configuration, three legs 2, sixteen long lateral braces 3, eight short lateral braces 4, ten pieces of dry dimensional lumber 7, and six plywood pieces 8 are used. Two of the dry dimensional lumber pieces 7 have been intentionally left off to highlight the top hat section 11 of a leg assembly 2.

Figure 4A:
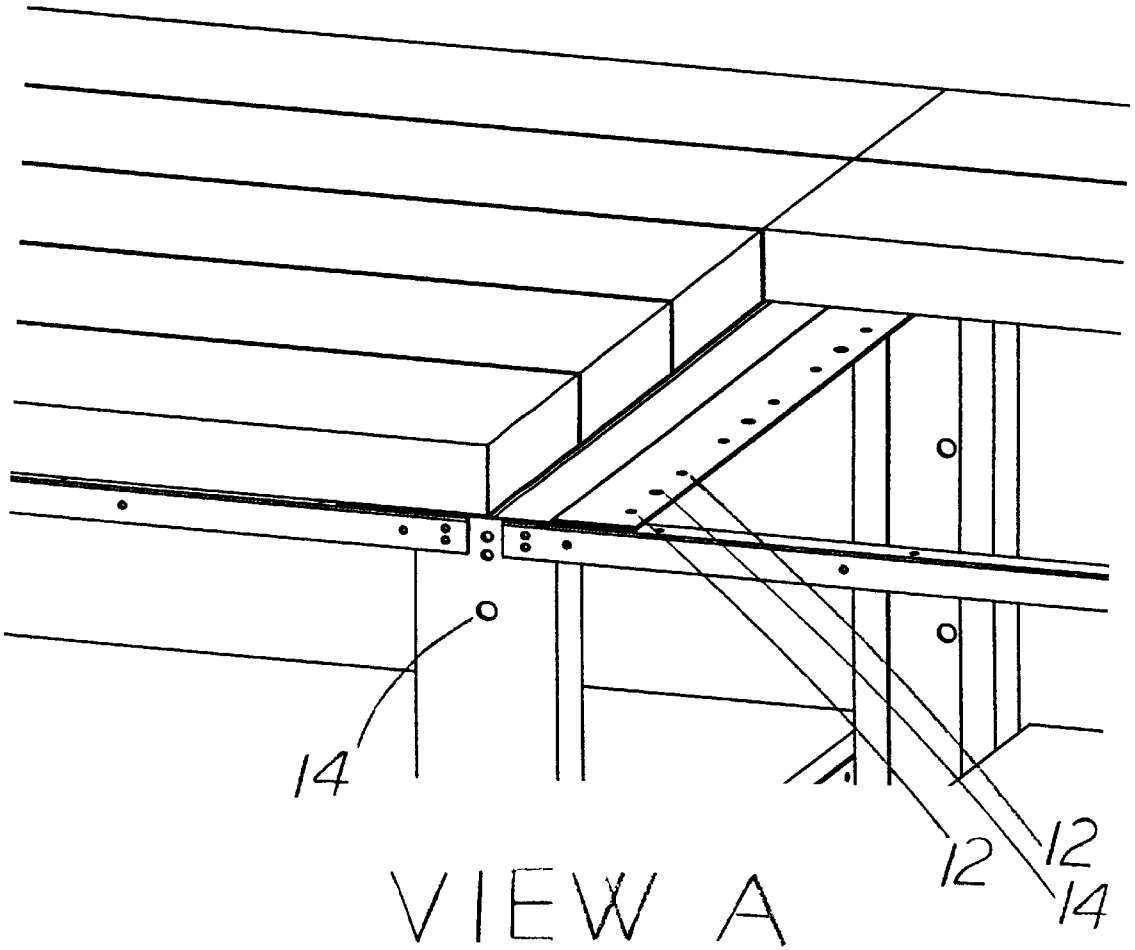
FIG. 4A is a partial view of FIG. 4 showing two sets of dimensional lumber attached to a single standard leg.

FIG. 4A provides a top sectional view of FIG. 4 showing the attachment of dry dimensional lumber 7 on a single standard leg assembly 2. This sectional view depicts that two sets dry dimensional lumber 7 can be attached via two sets of wood screw holes 12 and bolt holes 14 symmetrically spaced about the top hat section 11 of the standard leg assembly 2.

Figure 5:
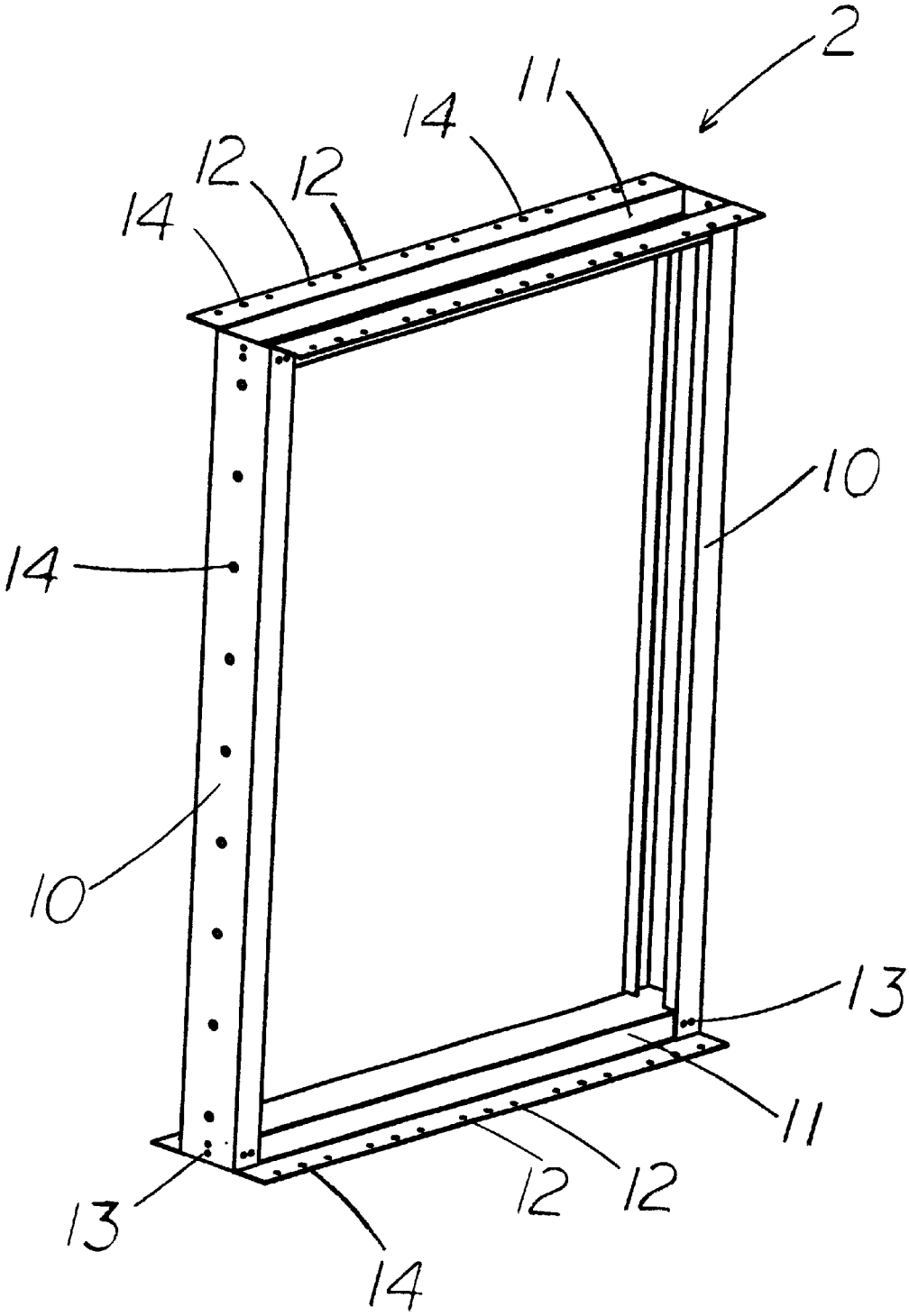
FIG. 5 is a plan view of the primary metal leg assembly.

FIG. 5 provides a perspective view of the metal leg frame 2. The height of the leg is arbitrary but the front to back length is equal to the average pre-cut lumber width multiplied by the integer number of lumber pieces used. For this leg shown, the width is equivalent to the face width of five 2×6 dry dimensional lumber pieces 7 laid side by side (plus some manufacturing tolerance). To provide strength, the leg is constructed from two metal top hat sections 11 and two vertical metal C-Purlin pieces 10. Attachment of the individual pieces 10,11 is either by welding or rivets. Three types of holes are pre-drilled in the assembly. Symmetrical about the center of the top hat sections and positioned to prevent warping or splitting of dry dimensional lumber are holes for wood screws 12. Positioned along the length of the C-Purlin 10 vertical pieces and on three of the four sides are lateral brace attachment holes 13 for attachment of all braces 3,4,5. Bolt holes 14 located along the top and bottom top hat sections 11, and along the center of the C-Purlin 10 are provided to aid the consumer in attachment of the leg to a floor, and or wall, or allow the user to bolt the dry dimensional lumber 7 to the top.

Figure 6:
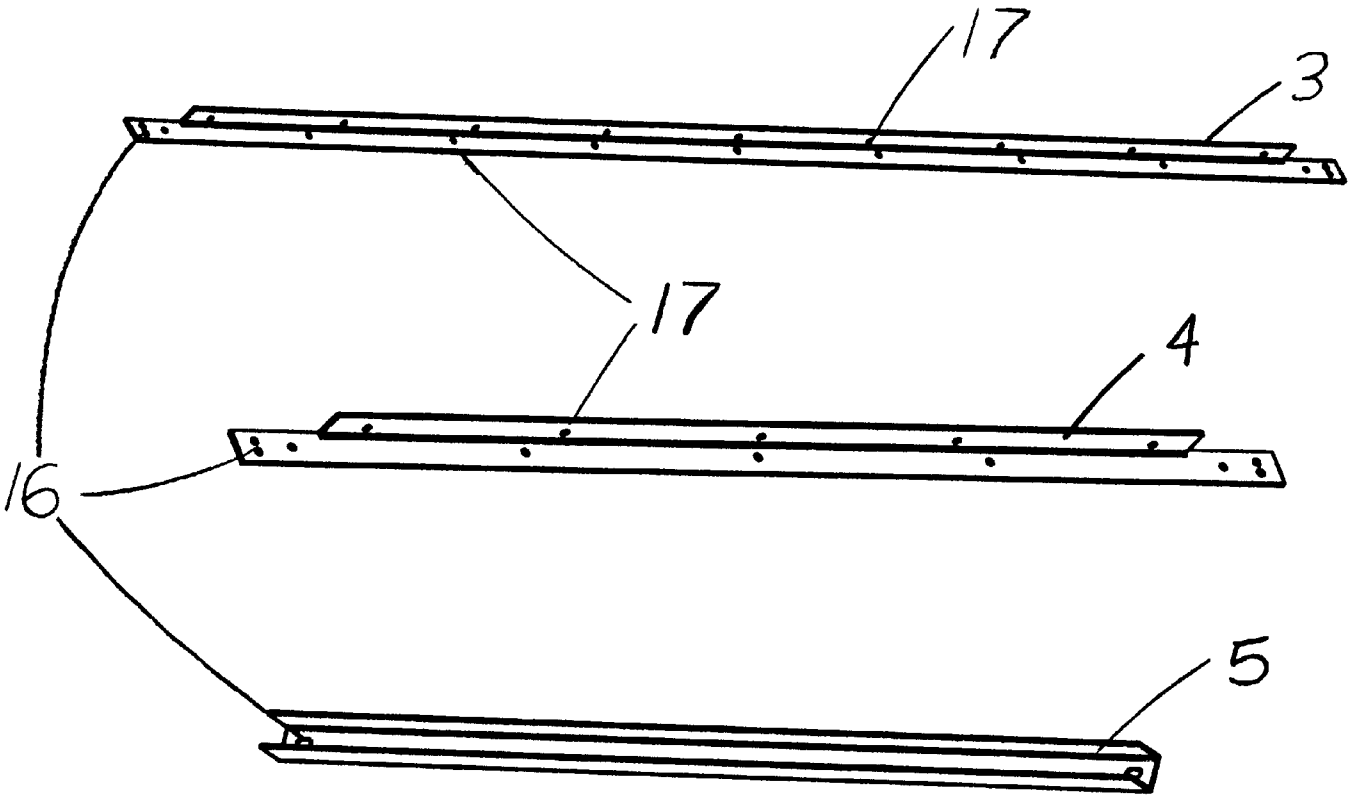
FIG. 6 is a plan view showing the two types of lateral braces along with the drawer U-shaped brace.

FIG. 6 provides a perspective view of the metal braces 3,4 and the U-channel drawer slide assembly 5. Both the short and long metal braces 3,4 are metal angle pieces with a pair of leg attachment holes 16 located at either end of the brace. There is a set of accessory holes 17 spaced periodically to allow the consumer to attach closure panels of wood or some other material if deemed necessary. The drawer support brace 5 is a simple U-shaped metal channel containing two leg attachment holes 16.

Figure 7:
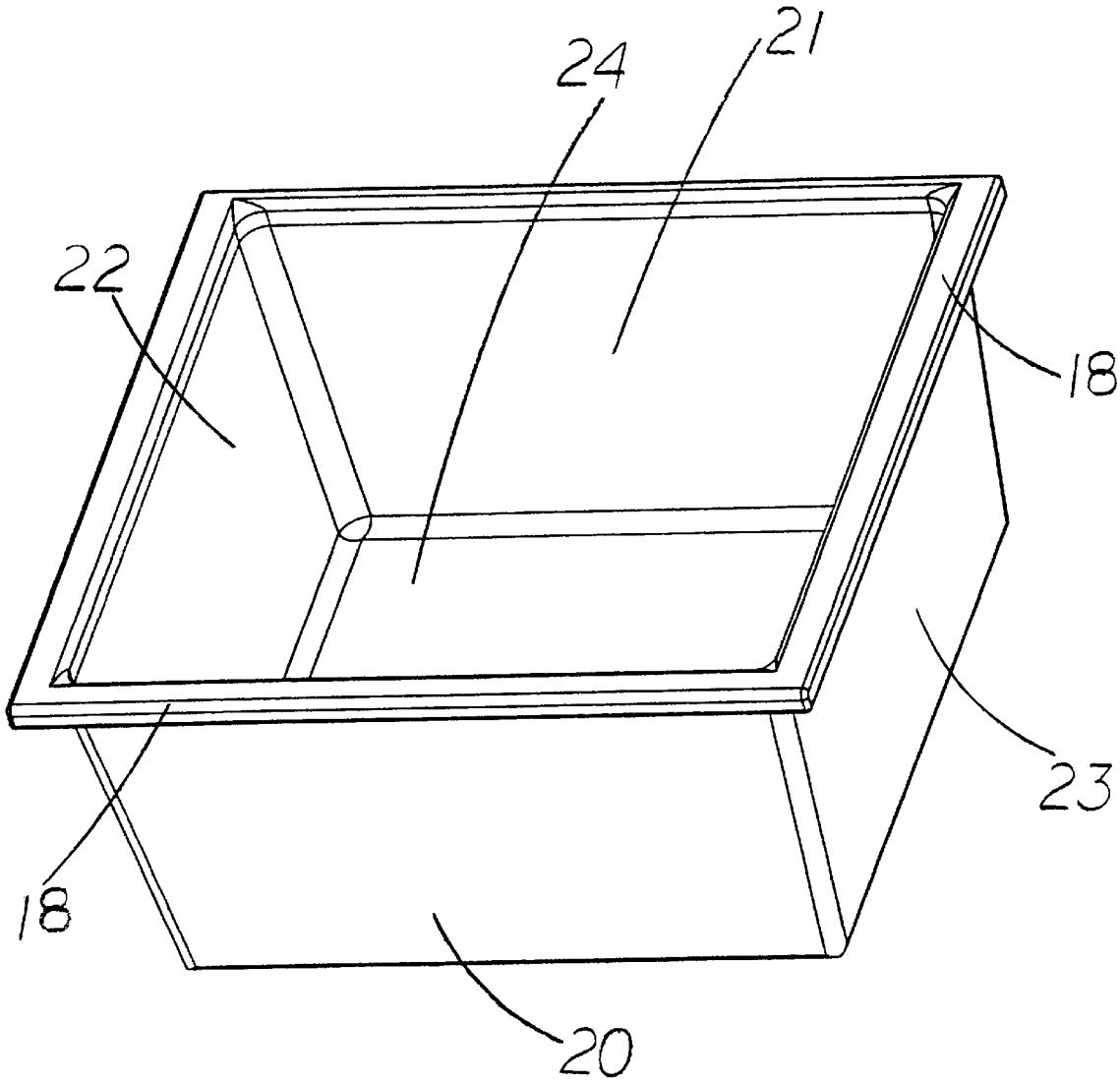
FIG. 7 is a top perspective view of the plastic injection-molded drawer assembly.

FIG. 7 provides a top perspective view of the drawer assembly 6. The drawer assembly is plastic injection-molded tapered box like structure composed of a front 20, rear 21, left 22, and right 23 sides, a bottom 24, and a structural support lip 18. The structural support lip 18 surrounds all four sides of the drawer 6 providing rigidity and providing a protrusion on the left and right side 22,23 that rests within the slot created by the U-shaped drawer support brace 5.

Figure 8:
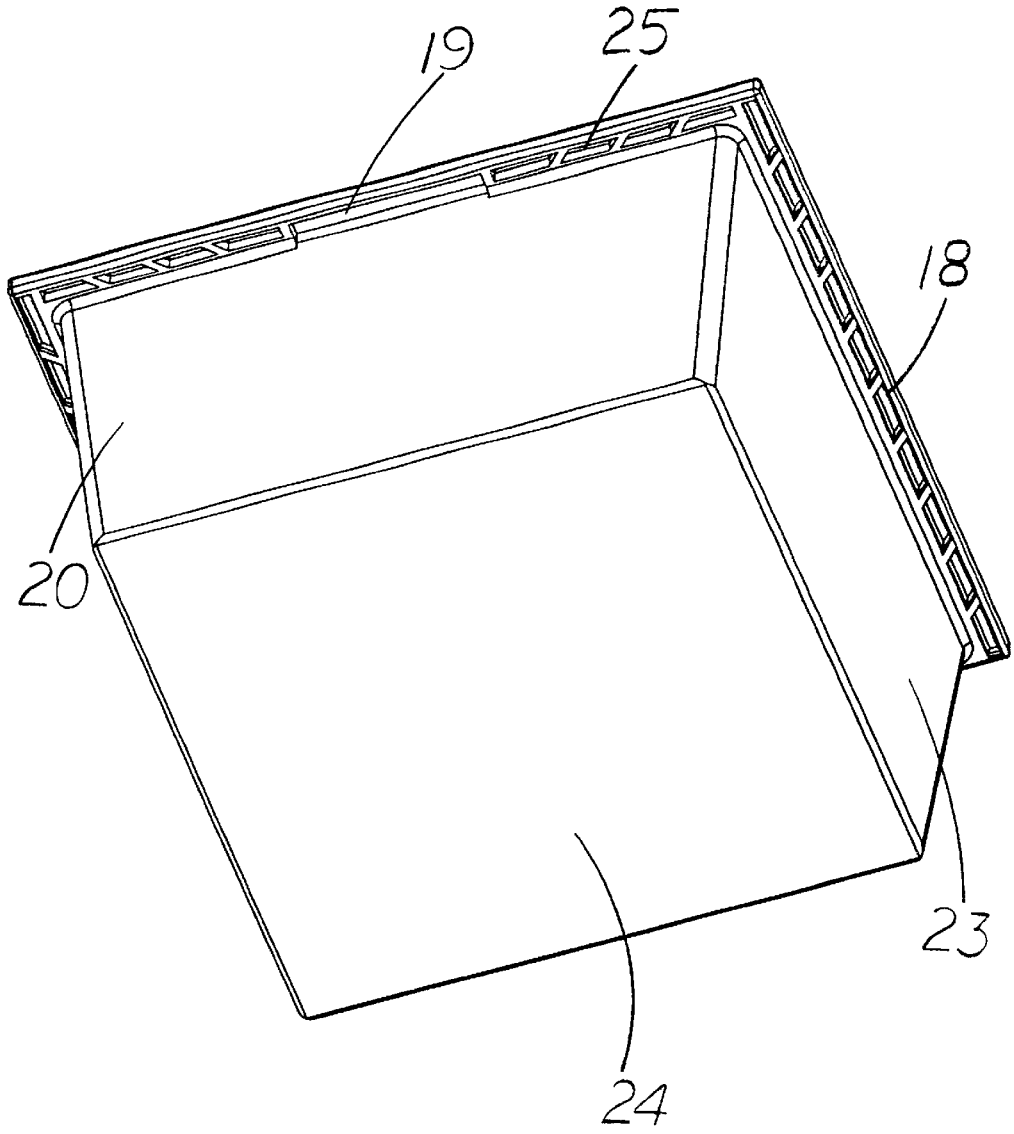
FIG. 8 is a bottom perspective view of the plastic injection-molded drawer assembly.

FIG. 8 provides a bottom perspective view of the drawer assembly shown in FIG. 7. Residing within the front structural lip of the drawer is an area designated as a handle lip 19 to aid in gripping the drawer during opening and closing. Structural support webbing 25 is depicted, but may or may not exist depending on material properties.

Although the drawings delineate a specific configuration and component design, such as the leg assembly, two types of lateral braces, a particular drawer, or drawer sliding assembly, etc.; it is to be understood that the invention shall not be limited in its construction or configuration to a specific component dimension or construction. It shall be understood that variations in leg width dimensions to accommodate various dry dimensional lumber types, or variations in individual component design, hardware attachment, or assembly that are made to improve producibility, reliability, or to respond to market demands, shall be within the scope of the present invention. Also, it should be understood that the phraseology and terminology employed is for the purpose of description and should not be regarded as limiting.

While the foregoing describes two embodiments of the present invention, the invention is not intended to be so restricted. Other embodiments, which will be apparent to one skilled in the art, and which utilize the teachings set forth, are intended to be within the scope and spirit of the invention.

We claim:

1. A workbench comprising:

a pair of metal leg members positioned to provide vertical support at left and right ends of said workbench, each of said leg members having a pair of flanges attached to a top end thereof, said flanges protruding in opposite outward directions from a central vertical axis of the leg member, each one of said flanges extending from a front end to a rear end of the leg member, each one of said flanges having a plurality of predrilled holes positioned linearly therein from front to rear, the distance from front to rear ends of each one of said leg members and its associated pair of flanges being equal to the product of an average width dimension of one of a desired integral number of like pieces of a specified size of standard dry dimensional lumber and said integral number;

the desired integral number of pieces, of equal length, of said specified size of standard dry dimensional lumber being attached in parallel lengthwise positions between said pair of metal leg members, utilizing selected ones of said predrilled holes in said flanges, to form a top working surface of said workbench.

2. A workbench as in claim 1, further comprising:

an additional one of said leg members positioned in spaced relationship to a selected one of said left and right ends of said workbench;

an additional integral number of pieces, of equal length, of said specified size of standard dry dimensional lumber being attached in parallel lengthwise positions between said additional one of said leg members and the selected end of said workbench, utilizing selected ones of said predrilled holes in said flanges, to thereby expand the length of said workbench.

3. A workbench comprising:

a pair of metal leg members positioned to provide vertical support at left and right ends of said workbench, the distance from front to rear ends of each one of said leg members being equal to the product of an average width dimension of one of a desired integral number of like pieces of a specified size of standard dry dimensional lumber and said integral number;

the desired integral number of pieces, of equal length, of said specified size of standard dry dimensional lumber being attached in parallel lengthwise positions between said pair of metal leg members to form a top working surface of said workbench.

4. A workbench as in claim 3, further comprising:

an additional one of said leg members positioned in spaced relationship to a selected one of said left and right ends of said workbench;

an additional said integral number of pieces, of equal length, of said specified size of standard dry dimensional lumber being attached in parallel lengthwise positions between said additional one of said leg members and the selected end of said workbench to thereby expand the length of said workbench.

* * * * *